US005567906A

United States Patent [19]

Reese et al.

[11] Patent Number: 5,567,906

[45] Date of Patent: Oct. 22, 1996

[54] TUNGSTEN ENHANCED LINER FOR A SHAPED CHARGE

[75] Inventors: James W. Reese, Sugar Land; Terry L. Slagle, Houston, both of Tex.

[73] Assignee: Western Atlas International, Inc., Houston, Tex.

[21] Appl. No.: 497,259

[22] Filed: Jun. 30, 1995

Related U.S. Application Data

[63] Continuation-in-part of Ser. No. 442,186, May 15, 1995.

[51] Int. Cl.[6] ..... F42B 1/02

[52] U.S. Cl. ..... 102/307; 102/476

[58] Field of Search ..... 102/307, 476

[56] References Cited

U.S. PATENT DOCUMENTS

| | | | |
|---|---|---|---|
| 4,498,367 | 2/1985 | Skolnick et al. | 86/1 R |
| 4,766,813 | 8/1988 | Winter et al. | 102/307 |
| 4,867,061 | 9/1989 | Stadler et al. | 102/307 |
| 4,966,750 | 10/1990 | LaSalle et al. | 102/501 X |
| 5,038,686 | 8/1991 | Zulkoski et al. | 102/496 |
| 5,090,324 | 2/1992 | Bocker et al. | 102/307 |
| 5,131,329 | 7/1992 | Lips et al. | 102/364 |
| 5,155,296 | 10/1992 | Michaluk | 102/476 |
| 5,221,808 | 6/1993 | Werner et al. | 102/307 |
| 5,251,561 | 10/1993 | Murphy | 102/307 |
| 5,413,048 | 5/1995 | Werner et al. | 102/307 |

*Primary Examiner*—Peter A. Nelson
*Attorney, Agent, or Firm*—Richard A. Fagin

[57] ABSTRACT

A liner for a shaped charge formed from a mixture of powdered tungsten and powdered metal binder. The liner is formed by compression of the mixture into a substantially conically shaped solid body. In a preferred embodiment of the invention, the mixture comprises approximately 80 percent by weight of tungsten and 20 percent of the powdered metal binder. In a specific embodiment of the invention, graphite powder is intermixed with the powdered metal binder and tungsten to act as a lubricant. The powdered metal binder preferably comprises a malleable, ductile metal such as lead, bismuth, tin, zinc, silver, antimony, cobalt, nickel or uranium.

16 Claims, 1 Drawing Sheet

TUNGSTEN ENHANCED LINER FOR A SHAPED CHARGE

CROSS-REFERENCE TO RELATED APPLICATIONS

The present application is a continuation-in-part of a patent application Ser. No. 442,186, filed on May 15, 1995, assigned to the assignee of the present invention and entitled "Tungsten Enhanced Liner for a Shaped Charge".

BACKGROUND OF THE INVENTION

1. Field of the Invention

The present invention relates generally to the field of explosive shaped charges. More specifically, the present invention relates to a composition of material for use as a liner in a shaped charge, particularly a shaped charge used for oil well perforating.

2. Description of the Related Art

Shaped charges are used for the purpose, among others, of making hydraulic communication passages, called perforations, in wellbores drilled through earth formations so that predetermined ones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore.

Shaped charges known in the art for perforating wellbores can include a housing, a quantity of high explosive of a composition such as HMX, RDX or HNS inserted into the housing, and a liner which is inserted onto the high explosive. The liner is typically formed into a generally conical shape by compressing powdered metal. The powdered metal typically used is primarily composed of copper. The powdered metal can include a fractional amount of lead mixed therewith, usually not more than twenty percent by weight. Alternatively, as disclosed in U.S. Pat. No. 5,221,808 issued to Werner et al for example, the lead can be substituted by bismuth.

When the high explosive is detonated, the force of the detonation collapses the liner and ejects it from one end of the charge at very high velocity in a pattern called a "jet". The jet penetrates the casing, the cement and a quantity of the formation. The quantity of the formation which may be penetrated by the jet can be estimated for a particular design shaped charge by test detonation of a similar shaped charge under standardized conditions which are specified in "Recommended Practice No. 43" ("RP-43") published by the American Petroleum Institute. The test procedure specified in RP-43 includes using a long cement "target" through which the jet partially penetrates. The depth of jet penetration through the RP-43 specification target for any particular type of shaped charge has a high degree of correspondence to the depth of jet penetration of a similar type charge through an earth formation.

In order to provide perforations which have efficient hydraulic communication with the formation, it is known in the art to design shaped charges in various ways to provide a jet which can penetrate a large quantity of formation, the quantity usually referred to as the "penetration depth" of the perforation. One method known in the art for increasing the penetration depth is to increase the quantity of explosive provided within the housing. A drawback to increasing the quantity of explosive is that some of the energy of the detonation is expended in directions other than the direction in which jet is expelled from the housing. As the quantity of explosive is increased, therefore, it is possible to increase the amount of detonation-caused damage to the wellbore and to equipment used to transport the shaped charge to the depth within the wellbore at which the perforation is to be made.

It is also known in the art to design the shape of the liner in various ways so as to maximize the penetration depth of the shaped charge for any particular quantity of explosive. Even if the shape of the liner were optimized, the amount of energy which can be transferred to the liner for making the perforation is necessarily limited by the quantity of explosive.

The copper/bismuth liner disclosed in the Werner et al '808 patent can reduce the environmental risk believed to be associated with lead deposited within the perforation by lead-containing charge liners, but as stated in the '808 patent, column 2 lines 48–49, the combination of bismuth and copper in the liner provides a shaped charge which "can shoot as well as the standard shaped charge" the standard charge being one which includes copper and lead in the liner material. Bismuth substituted for lead in the liner material does not provide increased penetration depth.

It is also known in the art to alter the composition of the liner to include powdered tungsten in substitution of some of the powdered copper in order to improve the performance of the shaped charge. Tungsten has been substituted in liners to compositions having as much as 35 percent by weight of tungsten. Those skilled in the art believed that substitution of higher fractional weights of tungsten in the liner material would not increase performance of the shaped charge because tests performed using liner tungsten concentrations exceeding 35 percent typically showed that the performance of the charges decreased. Therefore, liner compositions exceeding 35 percent by weight of tungsten were not used.

It is an object of the present invention to provide a liner material for a shaped charge which increases the penetration depth of the shaped charge by substitution of tungsten for most or all of the copper in the liner material.

SUMMARY OF THE INVENTION

The present invention is a liner for a shaped charge formed from a mixture of powdered tungsten and powdered metal binder. The liner is formed by compression of the mixture into a substantially conically shaped rigid body. In a preferred embodiment of the invention, the mixture comprises approximately 80 percent by weight of tungsten and 20 percent of the powdered metal binder.

In a specific embodiment of the invention, graphite powder is intermixed with the powdered metal binder and tungsten to act as a lubricant. The powdered metal binder preferably comprises a malleable, ductile metal such as lead, bismuth, tin, zinc, silver, antimony, cobalt, nickel or uranium.

DESCRIPTION OF THE PREFERRED EMBODIMENT

Figure 1:
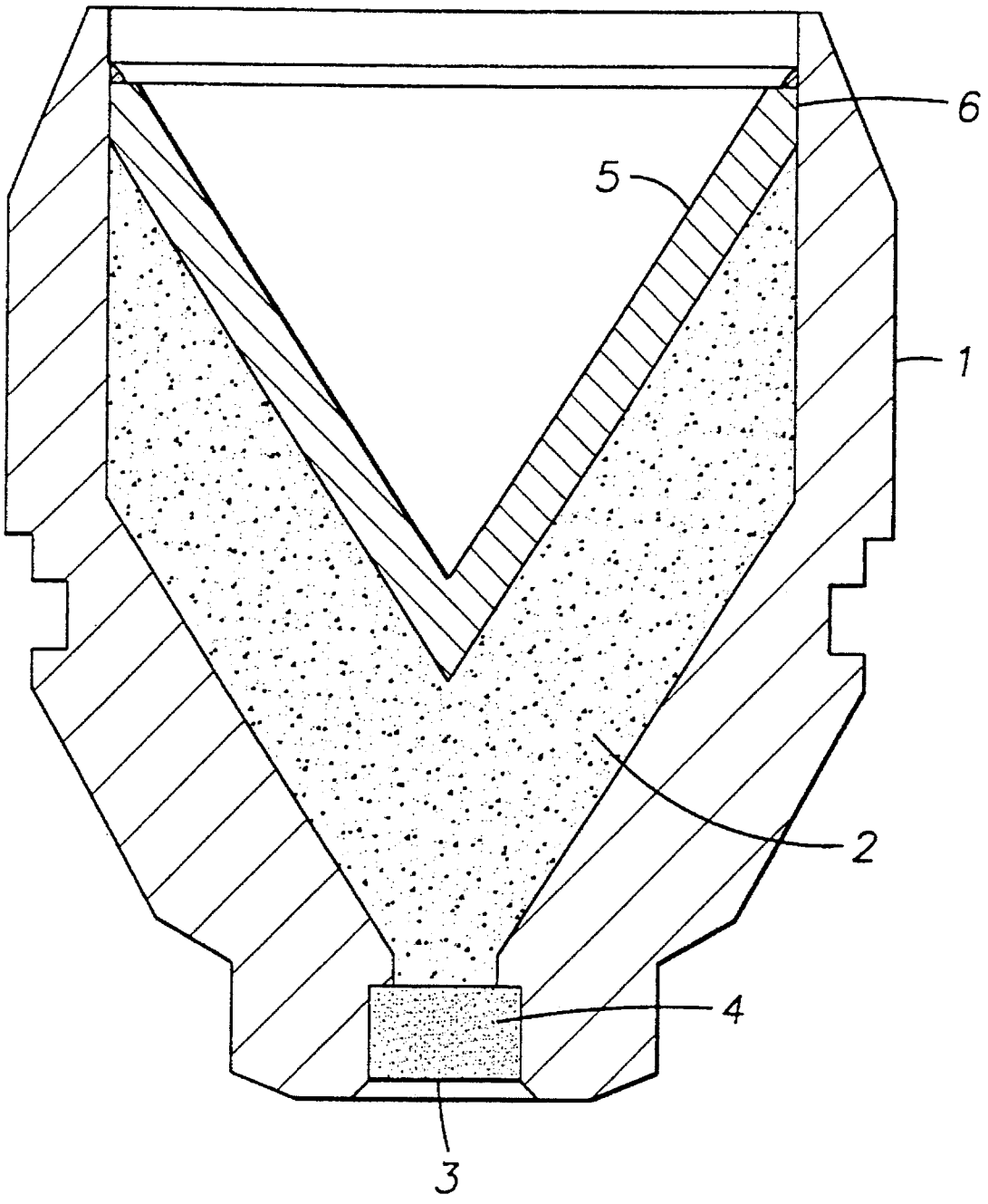
FIG. 1 shows a shaped charge having a liner according to the present invention.

A shaped charge 10 according to the present invention can be observed by referring to FIG. 1. The shaped charge 10 typically includes a generally cylindrically shaped housing 1, which can be formed from steel. A quantity of high explosive powder, shown generally at 2, is inserted into the interior of the housing 1. The high explosive 2 can be of a composition known in the art. High explosives known in the art for use in shaped charges include compositions sold under trade designations HMX, HNS, RDX, HNIW and TNAZ. A recess 4 formed at the bottom of the housing 1 can contain a booster explosive (not shown) such as pure RDX. The booster explosive, as is understood by those skilled in the art, provides efficient transfer to the high explosive 2 of a detonating signal provided by a detonating cord (not shown) which is typically placed in contact with the exterior of the recess 4. The recess 4 can be externally covered with a seal, shown generally at 3.

A liner, shown at 5, is typically inserted on to the high explosive 2 far enough into the housing 1 so that the high explosive 2 substantially fills the volume between the housing 1 and the liner 5. The liner 5 in the present invention can be made from powdered metal which is pressed under very high pressure into a generally conically shaped rigid body. The conical body is typically open at the base and is hollow. Compressing the powdered metal under sufficient pressure can cause the powder to behave substantially as a solid mass. The process of compressively forming the liner from powdered metal is understood by those skilled in the art.

As is understood by those skilled in the art, when the explosive 2 is detonated, either directly by signal transfer from the detonating cord (not shown) or transfer through the booster explosive (not shown), the force of the detonation collapses the liner 5 and causes the liner 5 to be ejected from the housing 1 at very high velocity.

A novel aspect of the present invention is the composition of the powdered metal from which the liner 5 can be formed. The powdered metal of the liner 5 of the present invention can consist of approximately 80 percent by weight of tungsten and 20 percent by weight of a powdered metal binder. Alternatively, the powdered metal of the liner 5 of the present invention can consist of 80 percent by weight of tungsten and 19 percent by weight of powdered metal binder with the addition of approximately 1 percent by weight of graphite powder intermixed therewith. The graphite powder acts as a lubricant, as is understood by those skilled in the art. As will be further explained, the penetration depth of the shaped charge 10 is improved by using powdered tungsten in the liner 5 material, compared with the depth of penetration achieved by shaped charges having liners of compositions known in the art which primarily include powdered copper.

The specified amount of powdered metal binder in the liner mixture of twenty percent by weight is not to be construed as an absolute limitation of the invention. It is known in the art to provide a fraction of powdered metal binder in a copper-based liner mixture which may vary by approximately five percentage points, to as much as 25 percent by weight or to as little as 15 percent by weight, and still provide effective shaped charge performance. It is contemplated that similar variations in the fraction of powdered metal binder may be provided in a tungsten-based liner mixture according to the present invention which will still provide increased depth of penetration of a shaped charge having a liner 5 formulated according to the present invention.

Typically, the powdered metal binder comprises powdered lead. Alternatively, as disclosed in U.S. Pat. No. 5,221,808 issued to Werner et al for example, the powdered metal binder can comprise bismuth. While lead and bismuth are more typically used for the powdered metal binder, other metals having high ductility and malleability can be used for the powdered metal binder. Other metals which have high ductility and malleability comprise tin, uranium, silver, gold, antimony, zinc, cobalt and nickel.

The present invention also provides for compositions for the liner 5 to include powdered copper intermixed with the powdered binder metal and powdered tungsten. Mixtures including as much as 20 percent by weight of copper, thereby reducing to 60 percent by weight the fraction of tungsten, and including approximately 20 percent by weight of powdered lead as the binder metal, have been test detonated and have demonstrated by such testing an increased depth of penetration relative to shaped charges having the copper-based liners known in the art.

The liner 5 can be retained in the housing 1 by application of adhesive, shown at 6. The adhesive 6 enables the shaped charge 10 to withstand the shock and vibration typically encountered during handling and transportation without movement of the liner 5 or the explosive 2 within the housing 1. It is to be understood that the adhesive 6 is only used for retaining the liner 5 in position within the housing 1 and is not to be construed as a limitation of the invention.

TEST RESULTS

Table 1 shows results of tests of depth of penetration of shaped charges having copper-based liners, compared to shaped charges having tungsten-based liners according to the present invention for several different types of shaped charges. Shaped charge types A and B were tested according to a specification published by the American Petroleum Institute called to as "Recommended Practice 43" ("RP-43"). Charge types C, D and E were tested in a concrete target, the concrete having a compressive strength within a range of 5,000 to 8,000 pounds per square inch, the target being covered by a ⅜ inch thick steel faceplate. The results in Table 1 represent an average penetration for test detonations of at least five charges of each type.

TABLE 1

| Charge | Copper Based Liner Penetration | Entry Hole Diameter | Tungsten Based Liner Penetration | Entry Hole Diameter |
|---|---|---|---|---|
| A | 19.45 | .40 | 25.1 | .28 |
| B | 12.42 | .27 | 15.69 | .23 |
| C | 14.2 | .31 | 17.2 | .29 |
| D | 9.3 | .42 | 12.3 | .33 |
| E | 17.8 | .48 | 19.2 | .44 |

The results of the tests as indicated in Table 1 indicate that the tungsten-based liner (shown in FIG. 1 as 5) provides approximately 25 percent increase in average depth of penetration for each. The entry hole diameter using the tungsten-based liner 5 is typically reduced to some degree compared with entry hole diameter created by the copper based liner 5 known in the art. In most circumstances, as is understood by those skilled in the art, the entry hole diameter can be less important than depth of penetration. It is concluded that the tungsten-based liner according to the present invention provides improved shaped charge performance compared with the charges known in the art.

Those skilled in the art will devise other configurations of shaped charges and liners which will not depart from the spirit of the invention. The scope of the invention should be limited only by the claims appended hereto.

What is claimed is:

1. A liner for a shaped charge comprising:

a mixture of powdered tungsten and powdered metal binder including approximately 80 percent by weight of said tungsten and approximately 20 percent by weight of said binder, said binder comprising a malleable, ductile metal selected from the group consisting of lead, bismuth, silver, gold, tin, uranium, antimony, zinc, cobalt and nickel, said mixture compressively formed into a substantially conically shaped rigid body.

2. The liner as defined in claim 1 further comprising powdered graphite intermixed with said tungsten and said powdered metal binder to act as a lubricant.

3. A liner for a shaped charge comprising:

a mixture of powdered tungsten, powdered metal binder and powdered copper, wherein said powdered copper comprises a fraction by weight of said mixture within a range of approximately zero to twenty percent, said powdered metal binder comprises a fraction by weight of said mixture of approximately twenty percent and said binder includes a malleable ductile metal selected from the group consisting of lead, bismuth, silver, gold, tin, uranium, antimony, zinc, cobalt and nickel, and said tungsten comprises a fraction by weight of said mixture within a range of approximately eighty to sixty percent, said copper substituting said tungsten weight for weight within said ranges for said copper and said tungsten, said mixture compressively formed into a substantially conically shaped rigid body.

4. The liner as defined in claim 3 further comprising powdered graphite intermixed with said mixture to act as a lubricant.

5. The liner as defined in claim 3 wherein said powdered metal binder comprises a malleable, ductile metal.

6. The liner as defined in claim 3 wherein said malleable ductile metal is selected from the group consisting of: lead, bismuth, silver, gold, tin, uranium, antimony, zinc, cobalt and nickel.

7. A shaped charge comprising:

a housing;

a quantity of high explosive inserted into said housing; and a liner inserted into said housing so that said high explosive is positioned between said liner and said housing, said liner compressively formed from a mixture of powdered tungsten and powdered metal binder, said mixture comprising approximately 80 percent by weight of said tungsten and approximately 20 percent by weight of said binder, said binder comprising a malleable, ductile metal selected from the group consisting of lead, bismuth, silver, gold, tin, uranium, antimony, zinc, cobalt and nickel.

8. The shaped charge as defined in claim 7 wherein said mixture comprises approximately 80 percent by weight of said tungsten and approximately 20 percent by weight of said powdered metal binder.

9. The mixture as defined in claim 7 further comprising powdered copper in substitution of said tungsten weight for weight wherein said powdered copper forms a fractional weight of said mixture within a range of approximately zero to twenty percent.

10. The shaped charge as defined in claim 7 further comprising powdered graphite intermixed with said tungsten and said powdered metal binder to act as a lubricant.

11. The shaped charge as defined in claim 7 further comprising a booster explosive disposed in said housing and in contact with said quantity of explosive, said booster explosive for transferring a detonating signal from a detonating cord in contact with the exterior of said housing to said high explosive.

12. The shaped charge as defined in claim 7 wherein said high explosive comprises RDX.

13. The shaped charge as defined in claim 7 wherein said high explosive comprises HMX.

14. The shaped charge as defined in claim 7 wherein said high explosive comprises HNS.

15. The shaped charge as defined in claim 7 wherein said high explosive comprises HNIW.

16. The shaped charge as defined in claim 7 wherein said high explosive comprises TNAZ.

* * * * *

US005567906B1

REEXAMINATION CERTIFICATE (3545th)

United States Patent [19] [11] B1 5,567,906

Reese et al. [45] Certificate Issued Jun. 9, 1998

[54] TUNGSTEN ENHANCED LINER FOR A SHAPED CHARGE

[75] Inventors: James W. Reese, Sugar Land; Terry L. Slagle, Houston, both of Tex.

[73] Assignee: Western Atlas International, Inc., Houston, Tex.

Reexamination Request:
No. 90/004,461, Nov. 19, 1996

Reexamination Certificate for:

| | |
|---|---|
| Patent No.: | **5,567,906** |
| Issued: | **Oct. 22, 1996** |
| Appl. No.: | **497,259** |
| Filed: | **Jun. 30, 1995** |

Related U.S. Application Data

[63] Continuation-in-part of Ser. No. 442,186, May 15, 1995.

[51] Int. Cl.[6] ..... F42B 1/02

[52] U.S. Cl. ..... 102/307; 102/476

[58] Field of Search ..... 102/306, 307, 102/312, 313, 476, 275.4; 175/4, 6

[56] References Cited

U.S. PATENT DOCUMENTS

| | | | |
|---|---|---|---|
| 4,613,370 | 9/1986 | Held et al. | 75/248 |
| 5,155,293 | 10/1992 | Barton | 102/312 |

*Primary Examiner*—Peter A. Nelson

[57] ABSTRACT

A liner for a shaped charge formed from a mixture of powdered tungsten and powdered metal binder. The liner is formed by compression of the mixture into a substantially conically shaped solid body. In a preferred embodiment of the invention, the mixture comprises approximately 80 percent by weight of tungsten and 20 percent of the powdered metal binder. In a specific embodiment of the invention, graphite owder is intermixed with the powdered metal binder and tungsten to act as a lubricant. The powdered metal binder preferably comprises a malleable, ductile metal such as lead, bismuth, tin, zinc, silver, antimony, cobalt, nickel or uranium.

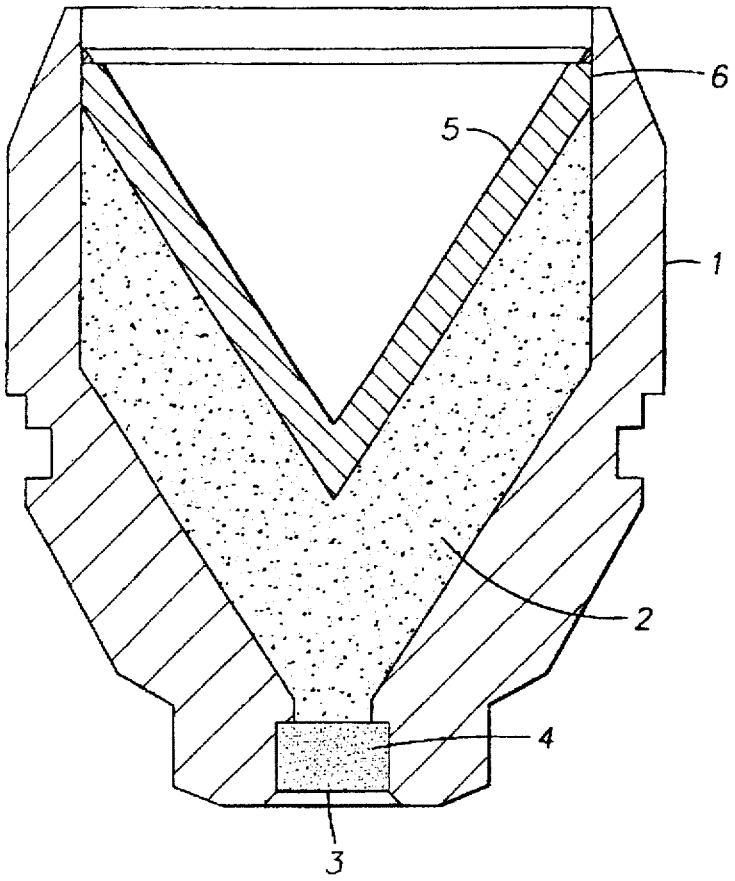

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 6, 8 and 9 are cancelled.

Claims 1, 3 and 7 are determined to be patentable as amended.

Claims 2, 4, 5 and 10-16, dependent on an amended claim, are determined to be patentable.

New claims 17-24 and 25-32 are added and determined to be patentable.

1. A liner for a shaped charge [comprising] *consisting of:* a mixture of powdered tungsten and powdered metal binder including approximately 80 percent by weight of said tungsten and approximately 20 percent by weight of said binder, said binder comprising a malleable, ductile metal selected from the group consisting of lead, bismuth, silver, gold, tin, uranium, antimony, zinc, cobalt and nickel, said *powdered metal* mixture [compressively] formed into a substantially conically shaped rigid body *by compression under sufficient pressure to cause said mixture to behave substantilly as a solid mass.*

3. A liner for a shaped charge [comprising] *consisting of:* a mixture of powdered tungsten, powdered metal binder and powdered copper, wherein said powdered copper [comprises] *forms* a fraction by weight of said mixture within a range of approximately zero to twenty percent, said powdered metal binder comprises a fraction by weight of said mixture of approximately twenty percent and said binder includes a malleable ductile metal selected from the group consisting of lead, bismuth, silver, gold, tin, uranium, antimony, zinc, cobalt, and nickel, and said tungsten comprises a fraction by weight of said mixture within a range of approximately eighty to sixty percent, said copper substituting said tungsten weight for weight within said ranges for said copper and said tungsten, said *powdered metal* mixture [compressively] formed into a substantially conically shaped rigid body *by compression under sufficient pressure to cause said powdered metal mixture to behave substantially as a solid mass.*

7. A shaped charge [comprising] *consisting of* :

a housing;

a quantity of high explosive inserted into said housing; and a liner inserted into said housing so that said high explosive is positioned between said liner and said housing, said liner [compressively] formed *into a substantially conically shaped rigid body* from a mixture of powdered tungsten and powdered metal binder, said *powdered metal* mixture comprising approximately 80 percent by weight of said tungsten and approximately 20 percent by weight of said binder, said binder comprising a malleable, ductile metal selected from the group consisting of lead, bismuth, silver, gold, tin, uranium, antimony, zinc, cobalt and nickel, *said powdered metal mixture compressed under sufficient pressure to cause said mixture to behave substantially as a solid mass.*

*17. A liner for a shaped charge comprising:*

*a mixture of powdered tungsten and powdered lead including approximately 80 percent by weight of said tungsten approximately 20 percent by weight of said powdered lead, said mixture compressively formed into a substantially conically shaped rigid body.*

*18. A liner for a shaped charge comprising:*

*a mixture of powdered tungsten, powdered lead and powdered copper, wherein said powdered copper comprises a fraction by weight of said mixture within a range of approximately zero to twenty percent, said powdered lead comprises a fraction by weight of said mixture of approximately twenty perent and said tungsten comprises a fraction by weight of said mixture within a range of approximately eighty to sixty percent, said copper substituting said tungsten weight for weight within said ranges of said copper and said tungsten, said mixture compressively formed into a substantially conically shaped rigid body.*

*19. A shaped charge comprising:*

*a housing;*

*a quantity of high explosive inserted into said housing; and*

*a liner inserted into said housing so that said high explosive is positioned between said liner and said housing, said liner compressively formed from a mixture of powdered tungsten and powdered lead, said mixture comprising approximately 80 percent by weight of said tungsten and approximately 20 percent by weight of said lead.*

*20. The shaped charge as defined in claim 19 further comprising powdered copper in substitution of said tungsten weight for weight wherein said powdered copper forms a fractional weight of said mixture within a range of approximately zero to twenty percent.*

*21. A liner for a shaped charge comprising:*

*a mixture of powdered tungsten and powdered bismuth including approximately 80 percent by weight of said tungsten and approximately 20 percent by weight of said powdered bismuth, said mixture compressively formed into a substantially conically shaped rigid body.*

*22. A liner for a shaped charge comprising:*

*a mixture of powdered tungsten, powdered bismuth and powdered copper, wherein said powdered copper comprises a fraction by weight of said mixture within a range of approximately zero to twenty percent, said powdered bismuth comprises a fraction by weight of said mixture of approximately twenty percent and said tungsten comprises a fraction by weight of said mixture within the range of approximately eighty to sixty percent, said copper substituting said tungsten weight for weight within said ranges for said copper and said tungsten, said mixture compressively formed into a substantially conically shaped rigid body.*

*23. A shaped charge comprising:*

*a housing;*

*a quantity of high explosive inserted into said housing; and*

*a liner inserted into said housing so that said high explosive is positioned between said liner and said*

*housing, said liner compressively formed from a mixture of powdered tungsten and powdered bismuth, said mixture comprising approximately 80 percent by weight of said tungsten and approximately 20 percent by weight of said bismuth.*

*24. The shaped charge as defined in claim 23 further comprising powdered copper in substitution of said tungsten weight for weight wherein said powdered copper forms a fractional weight of said mixture within a range of approximately zero to twenty percent.*

*25. A shaped charge consisting of:*

*a housing*

*a quantity of high explosive inserted into said housing; and*

*a liner inserted into said housing so that said high explosive is positioned between said liner and said housing, said liner formed into a substantially conically shaped rigid body from a mixture of powdered tungsten, powdered copper and powdered metal binder, said powdered metal mixture comprising approximately 80 percent to sixty percent by weight of tungsten, approximately 20 percent by weight of said binder, and approximately zero to 20 percent by weight of powdered copper wherein said powdered copper substitutes said powdered tungsten weight for weight, said binder comprising a malleable, ductile metal selected from the group consisiting of lead, bismuth, silver, gold, tin, uranium, antimony, zinc, cobalt and nickel, said powdered metal mixture compressed under sufficient pressure to cause said mixture to behave substantially as a solid mass.*

*26. The shaped charge as defined in claim 25 further comprising powdered graphite intermixed with said powdered metal mixture to act as a lubricant.*

*27. The shaped charge as defined in claim 25 further comprising a booster explosive disposed in said housing and in contact with said quantity of high explosive, said booster explosive for transferring a detonating signal from a detonating cord in contact with the exterior of said housing to said high explosive.*

*28. The shaped charge as defined in claim 25 wherein said high explosive comprises RDX.*

*29. The shaped charge as defined in claim 25 wherein said high explosive comprises HMX.*

*30. The shaped charge as defined in claim 25 wherein said high explosive comprises HNS.*

*31. The shaped charge as defined in claim 25 wherein said high explosive comprises HNIW.*

*32. The shaped charge as defined in claim 25 wherein said high explosive comprises TNAZ.*

* * * * *